US005161388A

United States Patent [19]

Fujita et al.

[11] Patent Number: 5,161,388

[45] Date of Patent: Nov. 10, 1992

[54] MULTI-SYSTEM AIR-CONDITIONING MACHINE IN WHICH OUTDOOR UNIT IS CONNECTED TO A PLURALITY OF INDOOR UNITS

[75] Inventors: Yoshinobu Fujita, Fuji; Toshiaki Kawamura, Shimizu; Tooru Kubo, Fuji; Mitsunobu Maezawa, Shimizu, both of Japan

[73] Assignee: Kabushiki Kaisha Toshiba, Kawasaki, Japan

[21] Appl. No.: 782,551

[22] Filed: Oct. 25, 1991

[30] Foreign Application Priority Data

Oct. 26, 1990 [JP] Japan ..... 2-287265

[51] Int. Cl.[5] ..... F25B 7/00

[52] U.S. Cl. ..... 62/175; 62/204; 62/217

[58] Field of Search ..... 62/204, 228.4, 217, 62/223, 175; 165/22

[56] References Cited

U.S. PATENT DOCUMENTS 4,720,982 1/1988 Shimizu et al. ..... 62/204
4,771,610 9/1988 Nakashima et al. ..... 62/160
4,926,653 5/1990 Masuda et al. ..... 62/223 X

FOREIGN PATENT DOCUMENTS 2194651 3/1988 United Kingdom .

*Primary Examiner*—William E. Wayner
*Attorney, Agent, or Firm*—Cushman, Darby & Cushman

[57] ABSTRACT

Electric expansion valves are provided midway along liquid-side pipes connected to indoor units. Electric flow control valves are provided midway along gas-side pipes connected to the indoor units. The indoor units detect air-conditioning loads, and a capability of a compressor is controlled in accordance with the sum of the air-conditioning loads. At the same time, the opening degrees of the flow control valves are controlled in accordance with the individual air-conditioning loads of the indoor units. In the heating operation mode, a high-pressure-side pressure of a refrigeration cycle is detected. When the high-pressure-side pressure becomes a preset value or more, an expansion valve and a flow control valve corresponding to an indoor unit whose operation is stopped are opened to predetermined opening degrees.

10 Claims, 5 Drawing Sheets

MULTI-SYSTEM AIR-CONDITIONING MACHINE IN WHICH OUTDOOR UNIT IS CONNECTED TO A PLURALITY OF INDOOR UNITS

BACKGROUND OF THE INVENTION

1. Field of the Invention

The present invention relates to a multi-system air-conditioning machine capable of performing air-conditioning of a plurality of rooms.

2. Description of the Related Art

In a multi-system air-conditioning machine, an outdoor unit is connected to a plurality of indoor units.

An example of such an air-conditioning machine includes one that has a plurality of two-way valves corresponding to the respective indoor units. Supply of a refrigerant to the respective indoor units is controlled by these two-way valves.

More specifically, in this air-conditioning machine, when one two-way valve is opened, the refrigerant flows in one indoor unit corresponding to the open two-way valve, and this indoor unit executes a cooling or heating operation. When one two-way valve is closed, a flow of the refrigerant to one indoor unit corresponding to the closed two-way valve is stopped, and the operation of this indoor unit is stopped.

In this air-conditioning machine, when e.g., two indoor units execute the heating operation, the heating operation of one of the indoor units is sometimes stopped. In this case, the refrigerant does not flow in the indoor unit which has stopped the operation.

When the number of operating indoor units is decreased, the output frequency of an inverter for driving a compressor is lowered. However, the discharge pressure of the compressor is not immediately decreased. On the contrary, it is largely increased, and a high-pressure-side pressure of a refrigeration cycle is increased to an abnormal degree. Then, the service life of the components constituting the refrigeration cycle is adversely affected.

In another air-conditioning machine, when the high-pressure-side pressure of the refrigeration cycle is increased over a preset value, the refrigerant of the high-pressure-side of the refrigeration cycle is bypassed to flow in the low-pressure-side, thereby forcibly suppressing an increase in the high-pressure-side pressure.

In still another air-conditioning machine, in order to suppress an increase in the high-pressure-side pressure, a two-way valve corresponding to an indoor unit whose operation is stopped is intermittently opened so that the refrigerant flows in this indoor unit as well.

However, in the air-conditioning machine in which supply of the refrigerant to the respective indoor units is controlled by the two-way valves, the respective indoor units are merely simply turned on or off, and a variation in the indoor temperature is large.

In the air-conditioning machine in which the refrigerant of the high-pressure-side is bypassed to flow in the low-pressure-side when the high-pressure-side pressure is increased, a so-called liquid return phenomenon in which a liquid refrigerant is quickly drawn by vacuum into the compressor sometimes occurs, resulting in damage to the compressor.

In the air-conditioning machine which flows the refrigerant even to an indoor unit whose operation is stopped, the amount of refrigerant to be flowed to the indoor unit whose operation is stopped must be increased to a degree not causing storing of the refrigerant, and thus the loss of the capability becomes large.

Published Unexamined Japanese Patent Application No. 63-61844 discloses a multi-system air-conditioning machine.

In this air-conditioning machine, an outdoor unit 4 has a compressor 6 and an outdoor heat exchanger 5, and a plurality of indoor units 1*a* and 1*b* respectively have indoor heat exchangers 3*a* and 3*b*. The flow of the refrigerant to the indoor heat exchangers 3*a* and 3*b* is controlled by electric expansion valves 2*a* and 2*b*.

More specifically, the output frequency of an inverter 7 for driving the compressor 6 is controlled in accordance with the sum of the air-conditioning loads of the indoor units 1*a* and 1*b*, and the opening degrees of the expansion valves 2*a* and 2*b* are controlled in accordance with the individual air-conditioning loads of the indoor units 1*a* and 1*b*, respectively.

In this air-conditioning machine, optimum amounts of refrigerant for the individual air-conditioning loads of the indoor units 1*a* and 1*b*, respectively, can be distributed to the indoor units 1*a* and 1*b*. Therefore, the variation in the indoor temperature can be suppressed to be small.

When the number of indoor units (1*a* and 1*b*) is decreased, even if the output frequency of the inverter 7 is decreased, the discharge pressure of the compressor 6 is not immediately decreased. On the contrary, it is largely increased, and thus the high-pressure-side pressure of the refrigeration cycle is increased to an abnormal degree.

SUMMARY OF THE INVENTION

It is an object of the present invention to distribute optimum amounts of refrigerant matching the individual air-conditioning loads of the respective indoor units to the respective indoor units, thereby minimizing a variation in the indoor temperature. It is another object of the present invention to suppress, when the number of operating indoor units in a heating operation mode is decreased, an abnormal increase in high-pressure-side pressure without causing an abrupt liquid returning to the compressor, thereby ensuring safety of the compressor and prolonging the service life of the components constituting the refrigeration cycle.

According to the present invention, there is provided a multi-system air-conditioning machine in which a single outdoor unit is connected to a plurality of indoor units, comprising:

- a variable-capability compressor, provided in the outdoor unit, for drawing by vacuum a refrigerant through a suction port, compressing the refrigerant, and discharging the refrigerant through a discharge port;
- a four-way valve for switching a flow direction of the refrigerant;
- an outdoor heat exchanger, provided in the outdoor unit, for exchanging heat of the refrigerant flowing therethrough for heat of outer air;
- a plurality of indoor heat exchangers, provided in the indoor units, respectively, for exchanging heat of the refrigerant flowing therethrough for heat of room air;
- a plurality of electric expansion valves for decreasing a pressure of the refrigerant flowing therethrough;
- a plurality of electric flow control valves for controlling an amount of refrigerant flowing therethrough;

a heat pump type refrigeration cycle in which the discharge port of the compressor is connected to the outdoor heat exchanger through the four-way valve, the outdoor heat exchanger is connected to the indoor heat exchangers through the expansion valves, and the indoor heat exchangers are connected to the suction port of the compressor through the flow control valves and the four-way valve;

means for flowing the refrigerant discharged from the compressor to the indoor heat exchangers through the four-way valve and the flow control valves, flowing the refrigerant output from the indoor heat exchangers to the outdoor heat exchanger through the expansion valves, and returning the refrigerant output from the outdoor heat exchanger to the compressor through the four-way valve, thereby executing a heating operation mode;

means, provided in the indoor units, for detecting air-conditioning loads based on a temperature of the room air;

means for controlling a capability of the compressor in accordance with a sum of the detected air-conditioning loads;

means for controlling opening degrees of the flow control valves in accordance with the detected air-conditioning loads;

means for detecting, in the heating operation mode, a pressure of the refrigerant flowing through a high-pressure-side of the refrigeration cycle; and means for opening one of the expansion valves and one of the flow control valves corresponding to one of the indoor units whose operation is stopped to a predetermined opening degree when the detected pressure is a preset value or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The first embodiment of the present invention will be described with reference to the accompanying drawings.

Figure 1:
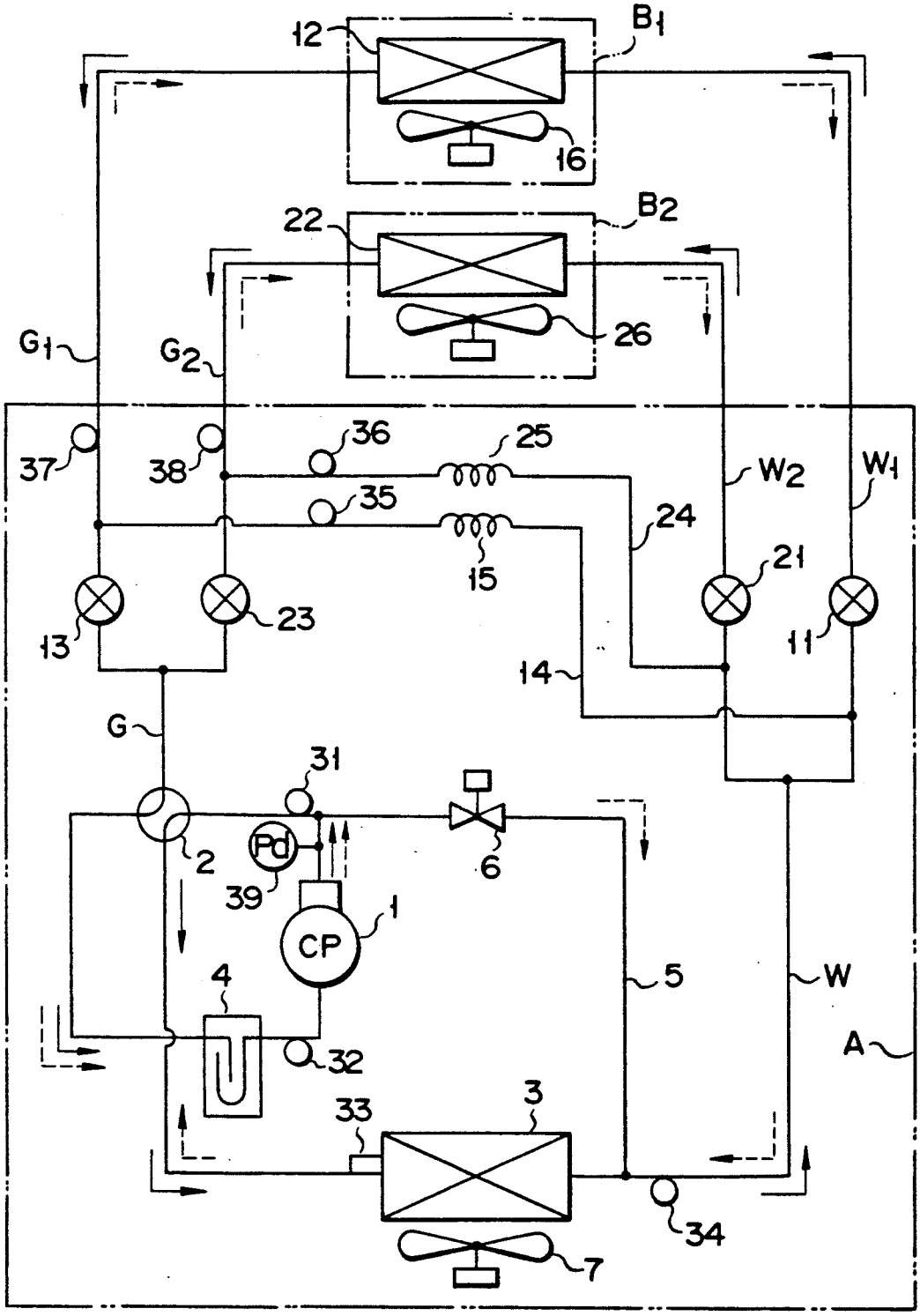
FIG. 1 is a view showing the configuration of the refrigeration cycles according to the first and second embodiments of the present invention.

As shown in FIG. 1, a single outdoor unit A is connected to a plurality of indoor units $B_1$ and $B_2$.

The following heat pump type refrigeration cycle is constituted by the units A, $B_1$, and $B_2$.

The outdoor unit A has a variable-capability compressor 1. The compressor 1 draws a refrigerant through its suction port by vacuum and compresses and discharges it through its discharge port. The compressor 1 is driven by a compressor motor 1M to be described later.

The discharge port of the compressor 1 is connected to an outdoor heat exchanger 3 through an electromagnetic four-way valve 2.

The four-way valve 2 switches the flow direction of the refrigerant. When the four-way valve 2 is not energized, it is set in a neutral state; when energized, it switches the flow direction.

The outdoor heat exchanger 3 exchanges the heat of the refrigerant flowing through it for the heat of the outer air.

The outdoor heat exchanger 3 is connected to a liquid-side pipe W. The liquid-side pipe W is branched into two liquid-side pipes $W_1$ and $W_2$. The liquid-side pipes $W_1$ and $W_2$ are connected to indoor heat exchangers 12 and 22. Electric expansion valves 11 and 21 are provided midway along the liquid-side pipes $W_1$ and $W_2$.

The indoor heat exchangers 12 and 22 exchange the heat of the refrigerant flowing through them for the heat of the room air and are provided in the indoor units $B_1$ and $B_2$, respectively.

The expansion valves 11 and 21 decrease the pressure of the refrigerant flowing through them. Each of the expansion valves 11 and 21 uses a pulse motor valve whose opening degree changes depending on the number of drive pulses supplied to it.

The indoor heat exchangers 12 and 22 are connected to gas-side pipes $G_1$ and $G_2$, respectively. Electric flow control valves 13 and 23 are provided midway along the gas-side pipes $G_1$ and $G_2$, respectively.

Each of the flow control valves 13 and 23 controls the amount of refrigerant flowing through it and uses a pulse motor valve whose opening degree changes depending on the number of drive pulses supplied to it.

The gas-side pipes $G_1$ and $G_2$ are coupled to a single gas-side pipe G. The gas-side pipe G is connected to the suction port of the compressor 1 through the four-way valve 2 and an accumulator 4.

One end of a bypass 5 is connected to the liquid-side pipe W. The other end of the bypass 5 is connected to a pipe between the discharge port of the compressor 1 and the four-way valve 2. An electromagnetic two-way valve 6 is provided midway along the bypass 5.

One end of a bypass 14 is connected to a portion of the liquid-side pipe $W_1$ branched from the liquid-side pipe W at a position near the branch point. The other end of the bypass 14 is connected to the gas-side pipe $G_1$ between the indoor heat exchanger 12 and the flow control valve 13. A capillary tube 15 is provided midway along the bypass 14.

One end of a bypass 24 is connected to a portion of the liquid-side pipe $W_2$ branched from the liquid-side pipe W at a position near the branch point. The other end of the bypass 24 is connected to the gas-side pipe $G_2$ between the indoor heat exchanger 22 and the flow control valve 23. A capillary tube 25 is provided midway along the bypass 24.

An outdoor fan 7 is provided in the vicinity of the outdoor heat exchanger 3. Indoor fans 16 and 26 are provided in the vicinities of the indoor heat exchangers 12 and 22, respectively.

A temperature sensor 31 is connected to the pipe between the discharge port of the compressor 1 and the four-way valve 2. That is, the temperature sensor 31 detects the temperature of the refrigerant flowing in the high-pressure-side of the refrigeration cycle (to be referred to as a high-pressure-side temperature hereinafter).

A temperature sensor 32 is connected to a low-pressure-side pipe between the suction port of the compressor 1 and the accumulator 4. That is, the temperature sensor 32 detects the temperature of the refrigerant drawn into the compressor 1.

A temperature sensor 33 is connected to the outdoor heat exchanger 3. In the heating operation mode in which the outdoor heat exchanger 3 operates as an evaporator, the temperature sensor 33 detects the temperature of the refrigerant flowing from the outdoor heat exchanger 3.

A temperature sensor 34 is connected to the liquid-side pipe W. In the heating operation mode in which the outdoor heat exchanger 3 operates as an evaporator, the temperature sensor 34 detects the temperature of the refrigerant flowing into the outdoor heat exchanger 3.

A temperature sensor 35 is connected to the other end portion of the bypass 14. In the cooling operation mode in which the indoor heat exchanger 12 of the indoor unit $B_1$ operates as an evaporator, the temperature of the refrigerant detected by the temperature sensor 35 corresponds to the saturation temperature of the refrigerant in the indoor heat exchanger 12.

A temperature sensor 36 is connected to the other end portion of the bypass 24. In the cooling operation mode in which the indoor heat exchanger 22 of the indoor unit $B_2$ operates as an evaporator, the temperature of the refrigerant detected by the temperature sensor 36 corresponds to the saturation temperature of the refrigerant in the indoor heat exchanger 22.

A temperature sensor 37 is connected midway along the gas-side pipe $G_1$ between the indoor heat exchanger 12 and the connecting portion of the bypass 14 connected to the pipe $G_1$. In the cooling operation mode in which the indoor heat exchanger 12 of the indoor unit $B_1$ operates as an evaporator, the temperature sensor 37 detects the temperature of the refrigerant flowing from the indoor heat exchanger 12.

A temperature sensor 38 is connected midway along the gas-side pipe $G_2$ between the indoor heat exchanger 22 and the connecting portion of the bypass 24 connected to the pipe $G_2$. In the cooling operation mode in which the indoor heat exchanger 22 of the indoor unit $B_2$ operates as an evaporator, the temperature sensor 38 detects the temperature of the refrigerant flowing from the indoor heat exchanger 22.

A pressure sensor 39 is connected to the pipe between the discharge port of the compressor 1 and the four-way valve 2. That is, the pressure sensor 39 detects the pressure of the refrigerant flowing in the high-pressure-side of the refrigeration cycle (to be referred to as a high-pressure-side pressure hereinafter).

Figure 2:
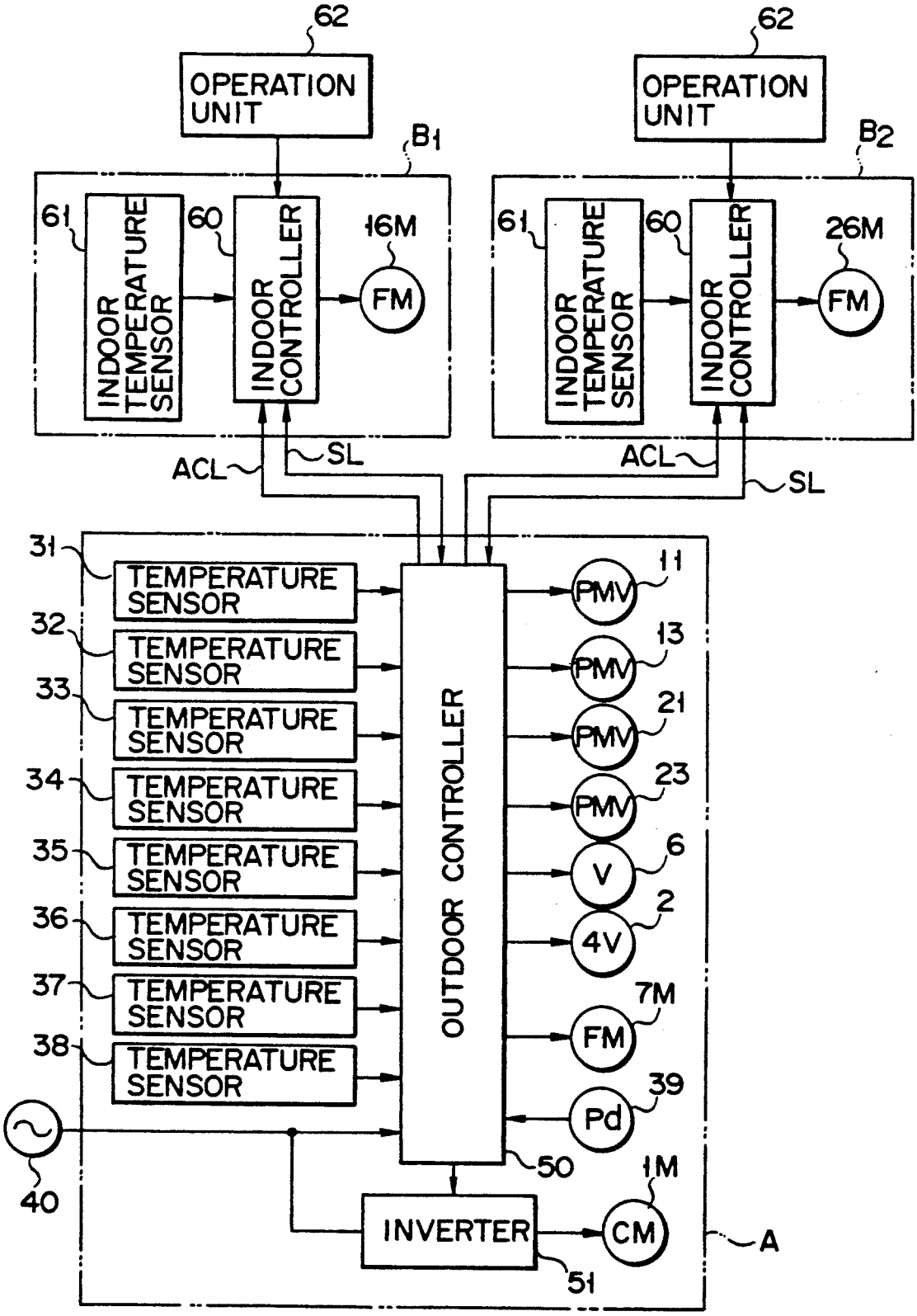
FIG. 2 is a block diagram showing the configuration of the control circuits of the first and second embodiments.

FIG. 2 shows a control circuit.

The outdoor unit A has an outdoor controller 50. The outdoor controller 50 is connected to a commercial AC power supply 40.

The outdoor controller 50 comprises a microcomputer and its peripheral circuits and performs the overall control of the outdoor unit A.

The outdoor controller 50 is connected to the expansion valve 11, the flow control valve 13, the expansion valve 21, the flow control valve 23, the two-way valve 6, the four-way valve 2, an outdoor fan motor 7M, the temperature sensors 31, 32, 33, 34, 35, 36, 37, and 38, the pressure sensor 39, and an inverter 51.

The inverter 51 rectifies the voltage of the commercial AC power supply 40, converts it to a voltage of a frequency and a level in accordance with a command from the outdoor controller 50, and outputs it. The output is supplied to the compressor motor 1M as a drive power.

Each of the indoor units $B_1$ and $B_2$ has an indoor controller 60.

Each indoor controller 60 comprises a microcomputer and its peripheral circuits and performs the overall control of the indoor unit $B_1$ or $B_2$.

Each indoor controller 60 is connected to a corresponding indoor temperature sensor 61, a corresponding remote control type operation unit 62, and a corresponding one of indoor fan motors 16M and 26M.

Each indoor controller 60 is connected to the outdoor controller 50 via a corresponding power supply line ACL and a corresponding serial signal line SL.

Each indoor controller 60 has the following functional means.

(1) A means for converting data of the operation mode and the preset temperature based on operation of the operation unit 62 to a serial signal synchronized with a power supply voltage and supplying it to the outdoor controller 50.

(2) A means for detecting a difference between a detection temperature detected by the indoor temperature sensor 61 and the preset temperature of the operation unit 62 as an air-conditioning load, converting it to a serial signal synchronized with the power supply voltage, and supplying it to the outdoor controller 50.

The outdoor controller 50 has the following functional means.

(1) A means for flowing the refrigerant discharged from the compressor 1 to the outdoor heat exchanger 3 through the four-way valve 2 upon reception of a command representing the cooling operation mode from the indoor units $B_1$ and $B_2$, flowing the refrigerant output from the outdoor heat exchanger 3 to the indoor heat exchangers 12 and 22 through the expansion valves 11 and 21, and returning the refrigerant output from the indoor heat exchangers 12 and 22 to the compressor 1 through the flow control valves 13 and 23, the four-way valve 2, and the accumulator 4, thereby executing the cooling operation.

(2) A means for controlling, in the cooling operation mode, the capability of the compressor 1 (=an output frequency F of the inverter 51) in accordance with the sum of the air-conditioning loads of the indoor units $B_1$ and $B_2$.

(3) A means for controlling, in the cooling operation mode, the opening degrees of the flow control valves 13 and 23 in accordance with the individual air-conditioning loads of the indoor units $B_1$ and $B_2$.

(4) A means for detecting, in the cooling operation mode, super-heat degrees of the refrigerant in the indoor heat exchangers 12 and 22, i.e., a difference between the detection temperatures of the temperature sensors 35 and 37 and a difference between the detection temperatures of the temperature sensors 36 and 38.

(5) A means for controlling the opening degrees of the expansion valves 11 and 21 so that the detected super-heat degrees become predetermined values.

(6) A means for completely closing, in the cooling operation mode, an expansion valve corresponding to the indoor unit $B_1$ or $B_2$ whose operation is stopped (including an interruption based on indoor temperature control) and opening a flow control valve corresponding to this indoor unit whose operation is stopped to a predetermined opening degree (e.g., corresponding to 250 drive pulses). This means aims at recovering the refrigerant and preventing freezing and dewing.

(7) A means for flowing the refrigerant discharged from the compressor 1 to the indoor heat exchangers 12 and 22 through the four-way valve 2 and the flow control valves 13 and 23 upon reception of a command representing the heating operation mode from the indoor units $B_1$ and $B_2$, flowing the refrigerant output from the indoor heat exchangers 12 and 22 to the outdoor heat exchanger 3 through the expansion valves 11 and 21, and returning the refrigerant output from the outdoor heat exchanger 3 to the compressor 1 through the four-way valve 2 and the accumulator 4, thereby executing the heating operation.

(8) A means for controlling, in the heating operation mode, the capability of the compressor 1 (=the output frequency F of the inverter 51) in accordance with the sum of the air-conditioning loads of the indoor units $B_1$ and $B_2$.

(9) A means for controlling, in the heating operation mode, the opening degrees of the flow control valves 13 and 23 in accordance with the individual requested capabilities of the indoor units $B_1$ and $B_2$.

(10) A means for detecting, in the heating operation mode, super-heat degree of the refrigerant in the outdoor heat exchanger 3, i.e., a difference between the detection temperatures of the temperature sensors 34 and 32.

(11) A means for simultaneously controlling the opening degrees of the expansion valves 11 and 21 by the same amount at a time so that the detected super-heat degree becomes a predetermined value.

(12) A means for opening, in the heating operation mode, an expansion valve and a flow control valve corresponding to the indoor unit $B_1$ or $B_2$ whose operation is stopped (including an interruption based on indoor temperature control) to predetermined opening degrees when a detection pressure Pd of the pressure sensor 39 becomes a preset value Pds or more. This means aims at increasing the total capacity of the indoor heat exchangers in order to decrease the condensation temperature, thereby suppressing an abnormal increase in the high-pressure-side pressure.

(13) A means for opening, in the heating operation mode, the two-way valve 6 when the detection temperature (=evaporation temperature) of the temperature sensor 33 becomes lower than the preset temperature. This means aims at defrosting the outdoor heat exchanger 3 by flowing a high-temperature refrigerant.

Figure 3:
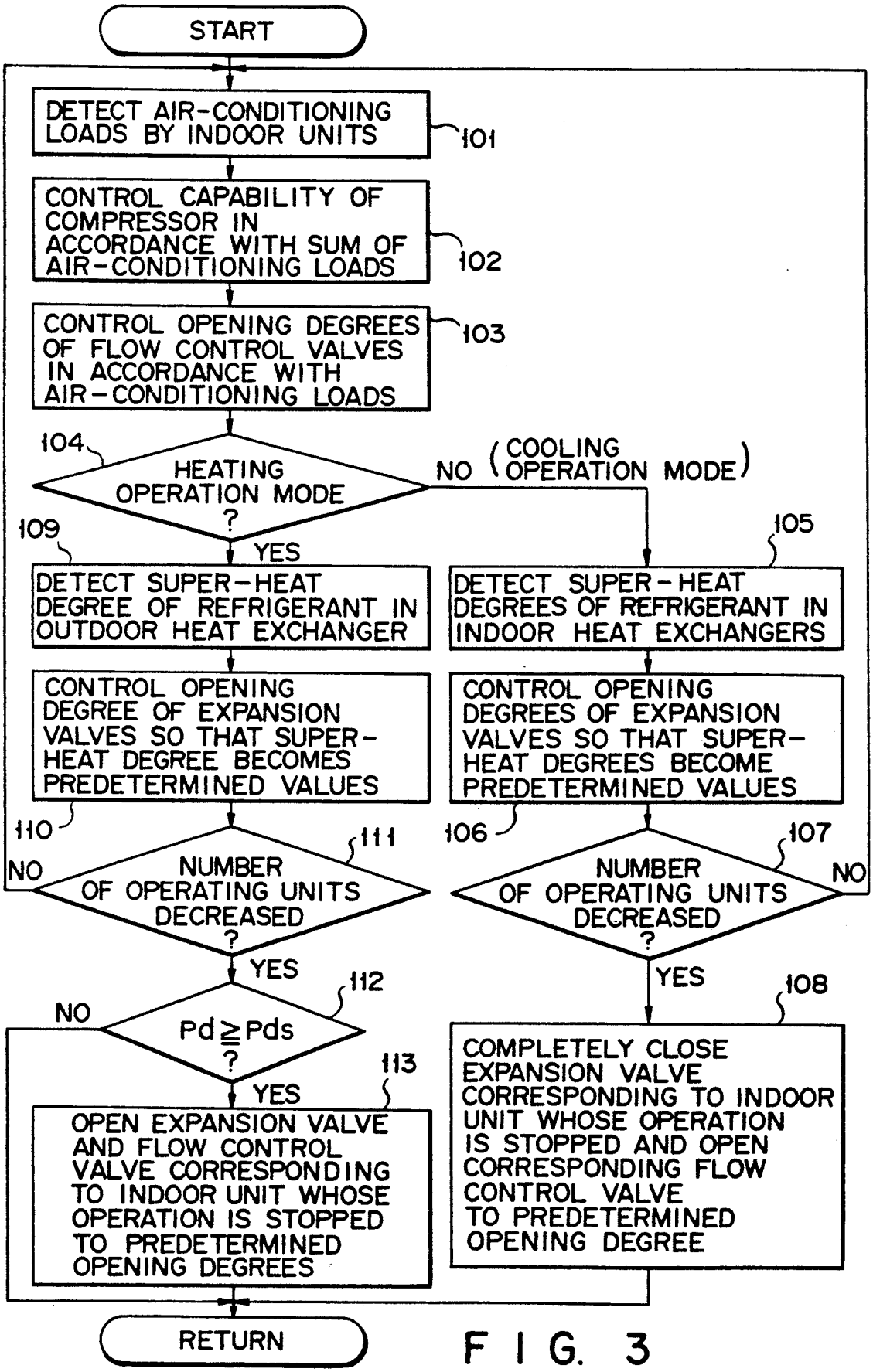
FIG. 3 is a flow chart for explaining the operation of the first embodiment.

The operation of this embodiment will be described with reference to FIG. 3.

Assume that the cooling operation mode and a desired indoor temperature are set by the operation units 62 of the indoor units $B_1$ and $B_2$ and that the operation is started.

In this case, the compressor 1 is started, and the refrigerant discharged by the compressor 1 flows in a direction indicated by a solid arrow in FIG. 1. Then, the outdoor heat exchanger 3 and the indoor heat exchangers 12 and 22 serve as the condenser and the evaporators, respectively, and the indoor units $B_1$ and $B_2$ start the cooling operation.

The air-conditioning loads are detected by the indoor units $B_1$ and $B_2$ (step 101).

The capability of the compressor 1 (=the output frequency F of the inverter 51) is controlled in accordance with the sum of the air-conditioning loads of the indoor units $B_1$ and $B_2$ (step 102). At the same time, the opening degree of the flow control valve 13 is controlled in accordance with the air-conditioning load of the indoor unit $B_1$ (step 103). The opening degree of the flow control valve 23 is controlled in accordance with the air-conditioning load of the indoor unit $B_2$ (step 103).

Since the cooling operation mode is set (step 104), the super-heat degree of the refrigerant in the indoor heat exchanger 12, i.e., a difference between the detection temperature of the temperature sensor 35 (=saturation temperature) and the detection temperature of the temperature sensor 37 is detected (step 105). The opening degree of the expansion valve 11 is controlled so that the detected super-heat degree becomes a predetermined value (step 106). Simultaneously, the super-heat degree of the refrigerant in the indoor heat exchanger 22, i.e., a difference between the detection temperature of the temperature sensor 36 (=saturation temperature) and the detection temperature of the temperature sensor 38 is detected (step 105). The opening degree of the expansion valve 21 is controlled so that the detected super-heat degree becomes a predetermined value (step 106). As a result, the flow amount of the refrigerant of the refrigeration cycle is maintained at an optimum value, and a stable operation is continued.

A case will be described in which only the indoor unit $B_1$ executes the cooling operation and the cooling operation of the indoor unit $B_2$ is stopped.

An air-conditioning load is detected by the indoor unit $B_1$ (step 101).

The capability of the compressor 1 (=the output frequency F of the inverter 51) is controlled in accordance with the air-conditioning load of the indoor unit $B_1$ (step 102). At the same time, the opening degree of the flow control valve 13 corresponding to the indoor unit $B_1$ is controlled in accordance with the air-conditioning load of the indoor unit $B_1$ (step 103).

Since the cooling operation mode is set (step 104), the super-heat degree of the refrigerant in the indoor heat exchanger 12, i.e., a difference between the detection temperature of the temperature sensor 35 (=saturation temperature) and the detection temperature of the temperature sensor 37 is detected (step 105). The opening degree of the expansion valve 11 is controlled so that the detected super-heat degree becomes a predetermined value (step 106).

Since the operation of the indoor unit $B_2$ is stopped (step 107), the expansion valve 21 corresponding to the indoor unit $B_2$ is completely closed, and the flow control valve 23 is opened to a predetermined opening degree (e.g., corresponding to 250 drive pulses) (step 108). As a result, the refrigerant in the indoor heat exchanger 22 is recovered to the compressor 1 side, and freezing and dewing of the indoor heat exchanger 22 are prevented.

Assume that the heating operation mode and a desired indoor temperature are set by the operation units 62 of the indoor units $B_1$ and $B_2$ and that the operation is started.

In this case, the refrigerant discharged by the compressor 1 flows in a direction indicated by a broken arrow in FIG. 1. Then, the outdoor heat exchanger 3 and the indoor heat exchangers 12 and 22 serve as the evaporator and the condensers, respectively, and the indoor units $B_1$ and $B_2$ start the heating operation.

The air-conditioning loads are detected by the indoor units $B_1$ and $B_2$ (step 101).

The capability of the compressor 1 (=the output frequency F of the inverter 51) is controlled in accordance with the sum of the air-conditioning loads of the indoor units $B_1$ and $B_2$ (step 102). At the same time, the opening degree of the flow control valve 13 is controlled in accordance with the air-conditioning load of the indoor unit $B_1$ (step 103). The opening degree of the flow control valve 23 is controlled in accordance with the air-conditioning load of the indoor unit $B_2$ (step 103).

Since the heating operation mode is set (step 104), the super-heat degree of the refrigerant in the outdoor heat exchanger 3, i.e., a difference between the detection temperature of the temperature sensor 34 and the detection temperature of the temperature sensor 32 is detected (step 109). The opening degrees of the expansion valves 11 and 21 are simultaneously controlled by the same amount at a time so that the detected super-heat degree becomes a predetermined value (step 110). As a result, the flow amount of the refrigerant of the refrigeration cycle is maintained at an optimum value, and a stable operation is continued.

A case will be described in which only the indoor unit $B_1$ executes the heating operation and the heating operation of the indoor unit $B_2$ is stopped.

An air-conditioning load is detected by the indoor unit $B_1$ (step 101).

The capability of the compressor 1 (=the output frequency F of the inverter 51) is controlled in accordance with the air-conditioning load of the indoor unit $B_1$ (step 102). At the same time, the opening degree of the flow control valve 13 corresponding to the indoor unit $B_1$ is controlled in accordance with the air-conditioning load of the indoor unit $B_1$ (step 103).

Since the heating operation mode is set (step 104), the super-heat degree of the refrigerant in the outdoor heat exchanger 3, i.e., a difference between the detection temperature of the temperature sensor 34 and the detection temperature of the temperature sensor 32 is detected (step 109). The opening degree of the expansion valve 11 is controlled so that the detected super-heat degree becomes a predetermined value (step 110).

In the heating operation mode, when an overload occurs, the high-pressure-side pressure can be easily increased. In particular, when the number of operating indoor units is decreased, the total capacity of the indoor heat exchangers is decreased. Therefore, even when the output frequency F of the inverter 51 is decreased, the high-pressure-side pressure is not quickly decreased. On the contrary, it can be largely increased over an allowable value.

However, when the number of operating indoor units ($B_1$ and $B_2$) is decreased (step 111) and the detection pressure Pd of the pressure sensor 39 becomes the preset value Pds or more (step 112), the expansion valve 21 and the flow control valve 23 corresponding to the indoor unit $B_2$ whose operation is stopped are opened to predetermined opening degrees (step 113).

When the expansion valve 21 and the flow control valve 23 are open at the predetermined opening degrees, the refrigerant flows in the indoor heat exchanger 22.

In this manner, when the refrigerant flows in the indoor unit whose operation is stopped, the total capacity of the indoor heat exchangers is increased to decrease the condensation temperature, thereby suppressing an abnormal increase in the high-pressure-side pressure. As the result, the service life of the components constituting the refrigeration cycle can be prolonged.

In addition, unlike in the conventional case in which the refrigerant on the high-pressure-side is bypassed to flow in the low-pressure-side, a quick liquid return to the compressor does not occur. As a result, the safety of the compressor 1 is ensured.

The flow control valves 13 and 23 are provided midway along the gas-side pipes $G_1$ and $G_2$ connected to the indoor units $B_1$ and $B_2$, and the opening degrees of the flow control valves 13 and 23 are controlled in accordance with the individual air-conditioning loads of the indoor units $B_1$ and $B_2$. Therefore, optimum amounts of refrigerant matching the individual indoor units $B_1$ and $B_2$ can be distributed to the indoor units $B_1$ and $B_2$. As a result, a variation in the indoor temperature can be minimized, and a comfortable air-conditioning can be achieved.

The second embodiment of the present invention will be described.

The configuration of the refrigeration cycle is the same as that shown in FIG. 1.

Regarding the control circuit, only the functional means of the outdoor controller 50 of FIG. 2 are different.

The outdoor controller 50 has the following functional means. Note that the functional means (1) to (11) are identical to those of the first embodiment.

(1) A means for flowing the refrigerant discharged from the compressor 1 to the outdoor heat exchanger 3 through the four-way valve 2 upon reception of a command representing the cooling operation mode from the indoor units $B_1$ and $B_2$, flowing the refrigerant output from the outdoor heat exchanger 3 to the indoor heat exchangers 12 and 22 through the expansion valves 11 and 21, and returning the refrigerant output from the indoor heat exchangers 12 and 22 to the compressor 1 through the flow control valves 13 and 23, the four-way valve 2, and the accumulator 4, thereby executing the cooling operation.

(2) A means for controlling, in the cooling operation mode, the capability of the compressor 1 (=an output frequency F of the inverter 51) in accordance with the sum of the air-conditioning loads of the indoor units $B_1$ and $B_2$.

(3) A means for controlling, in the cooling operation mode, the opening degrees of the flow control valves 13 and 23 in accordance with the individual air-conditioning loads of the indoor units $B_1$ and $B_2$.

(4) A means for detecting, in the cooling operation mode, super-heat degrees of the refrigerant in the indoor heat exchangers 12 and 22, i.e., a difference between the detection temperatures of the temperature sensors 35 and 37 and a difference between the detection temperatures of the temperature sensors 36 and 38.

(5) A means for controlling the opening degrees of the expansion valves 11 and 21 so that the detected super-heat degrees become predetermined values.

(6) A means for completely closing, in the cooling operation mode, an expansion valve corresponding to the indoor unit $B_1$ or $B_2$ whose operation is stopped (including an interruption based on the indoor temperature control) and opening a flow control valve corresponding to this indoor unit whose operation is stopped to a predetermined opening degree (e.g., corresponding to 250 drive pulses). This means aims at recovering the refrigerant and preventing freezing and dewing.

(7) A means for flowing the refrigerant discharged from the compressor 1 to the indoor heat exchangers 12 and 22 through the four-way valve 2 and the flow control valves 13 and 23 upon reception of a command representing the heating operation mode from the indoor units $B_1$ and $B_2$, flowing the refrigerant output from the indoor heat exchangers 12 and 22 to the outdoor heat exchanger 3 through the expansion valves 11 and 21, and returning the refrigerant output from the outdoor heat exchanger 3 to the compressor 1 through the four-way valve 2 and the accumulator 4, thereby executing the heating operation.

(8) A means for controlling, in the heating operation mode, the capability of the compressor 1 (=the output frequency F of the inverter 51) in accordance with the sum of the air-conditioning loads of the indoor units $B_1$ and $B_2$.

(9) A means for controlling, in the heating operation mode, the opening degrees of the flow control valves 13 and 23 in accordance with the individual requested capabilities of the indoor units $B_1$ and $B_2$.

(10) A means for detecting, in the heating operation mode, super-heat degree of the refrigerant in the outdoor heat exchanger 3, i.e., a difference between the detection temperatures of the temperature sensors 34 and 32.

(11) A means for simultaneously controlling the opening degrees of the expansion valves 11 and 21 by the same amount at a time so that the detected super-heat degree becomes a predetermined value.

(12) A means for opening, in the heating operation mode, an expansion valve and a flow control valve corresponding to the indoor unit $B_1$ or $B_2$ whose operation is stopped (including an interruption based on indoor temperature control) to small opening degrees (e.g., corresponding to 20 drive pulses). This means aims at increasing the total capacity of the indoor heat exchangers by flowing the refrigerant in the indoor unit whose operation is stopped, so that the condensation temperature is decreased, thereby suppressing an abnormal increase in the high-pressure-side pressure. In particular, since the opening degrees are decreased, the flow amount of the refrigerant in an operating indoor unit is prevented from being short, and a decrease in the capability is prevented.

(13) A means for increasing, in the heating operation mode, the opening degrees of the expansion valve and a flow control valve corresponding to the stopped indoor unit to respective predetermined values (e.g., corresponding to 50 drive pulses) when the detection temperature Td (the temperature of the refrigerant discharged from the compressor 1) of the temperature sensor 31 is the preset value Tds or more and when an expansion valve (controlled in order to maintain the predetermined super-heat degree) corresponding to an operating indoor unit is almost completely opened. This means aims at eliminating inevitable storing of the refrigerant in the stopped indoor unit due to the small preset opening degrees. That is, the refrigerant stored in the stopped indoor unit is caused to flow in the liquid side by increasing the opening degree, so that a sufficient amount of refrigerant can be obtained in the operating indoor unit.

Figure 4:
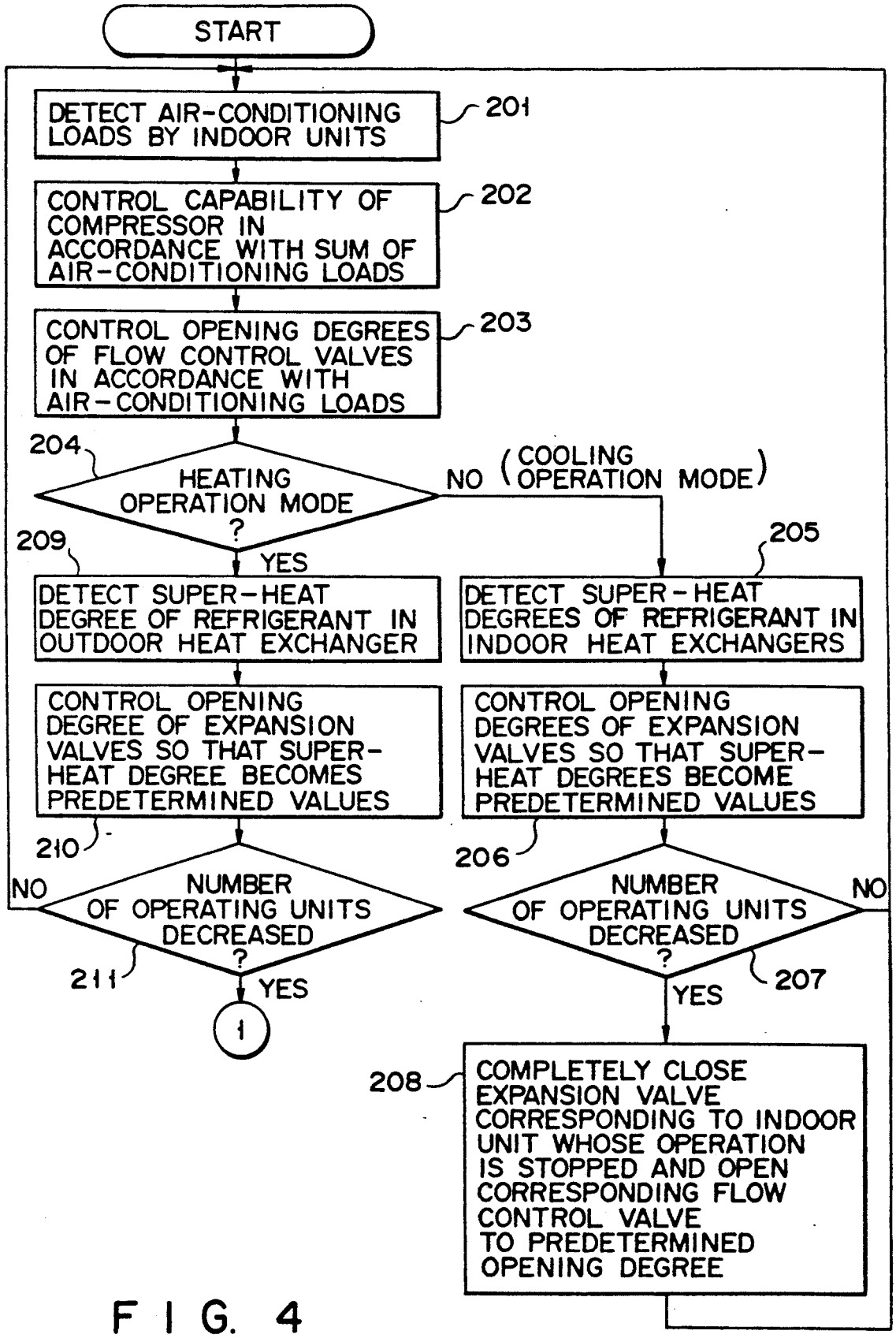
FIGS. 4 and 5 are flow charts for explaining the operation of the second embodiment.
Figure 5:
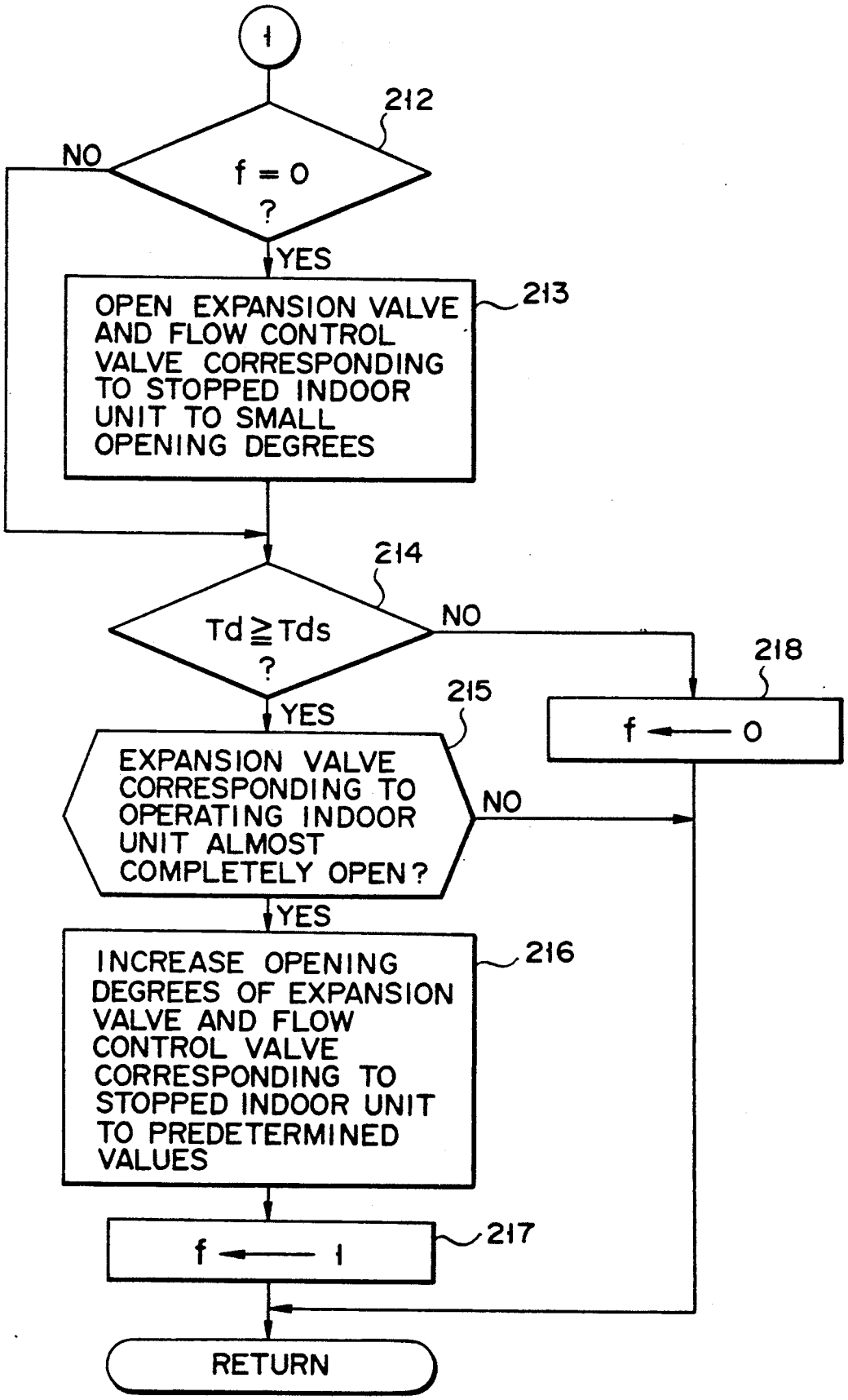

The operation of the second embodiment will be described with reference to FIGS. 4 and 5.

The operations from steps 201 to 211 are identical to the operations from steps 101 to 111 of the first embodiment.

Upon start of the heating operation by the single indoor unit $B_1$, the content of a flag f of the outdoor controller 50 is confirmed (step 212).

If the flag f is reset (=0), the expansion valve 21 and the flow control valve 23 corresponding to the stopped indoor unit $B_2$ are opened to opening degrees (corresponding to 20 drive pulses) (step 213).

When the expansion valve 21 and the flow control valve 23 are opened to small opening degrees, a small amount of refrigerant flows in the indoor heat exchanger 22.

Therefore, the total capacity of the indoor heat exchangers is increased to decrease the condensation temperature, so that an abnormal increase in the high-pressure-side pressure is suppressed. In addition, since the opening degrees of the expansion valve 21 and the flow control valve 23 are small, the flow amount of the refrigerant in the operating indoor unit $B_1$ can be prevented from being short.

However, if the operation proceeds in this state, the refrigerant is gradually stored in the stopped indoor unit $B_2$, and finally the flow amount of the refrigerant in the operating indoor unit $B_1$ becomes short.

When the flow amount of the refrigerant in the indoor unit $B_1$ is short, the super-heat degree of the refrigerant in the indoor heat exchanger 12 is increased, leading to an abnormal increase in the high-pressure-side temperature.

In this case, the opening degree of the expansion valve 11 is increased so as to maintain the super-heat degree of the refrigerant at a predetermined value. However, this increase in the opening degree cannot catch up with the increase in the super-heat degree of the refrigerant, and the expansion valve 11 becomes almost completely opened.

When the high-pressure-side temperature (temperature of the refrigerant discharged from the compressor 1) Td becomes the preset value Tds or more (step 214) and when the expansion valve 11 is almost completely opened (step 215), the opening degrees of the expansion valve 21 and the flow control valve 23 corresponding to the stopped indoor unit $B_2$ are increased to predetermined values (corresponding to 50 drive pulses) (step 216). At this time, the flag f is set (=1) (step 217).

When the opening degrees of the expansion valve 21 and the flow control valve 23 are increased, the refrigerant stored in the indoor heat exchanger 22 flows to the liquid side, and a sufficient amount of refrigerant is obtained in the indoor unit $B_1$.

Therefore, the super-heat degree of the refrigerant in the indoor heat exchanger 12 is decreased, and an abnormal increase in the high-pressure-side temperature Td, and thus an abnormal increase in the high-pressure-side pressure Pd, can be suppressed. That is, the flow amount of the refrigerant of the refrigeration cycle is maintained at an optimum state, and a stable operation is continued.

When the high-pressure-side temperature Td is decreased to the preset value Tds or less (step 214), the flag f is reset (=0) (step 218), and a normal operation starting from step 201 is restored.

That is, unlike in the conventional case in which the two-way valve is intermittently opened, the amount of refrigerant to be flowed to the stopped indoor unit need not be set large from the beginning. Therefore, a loss in the capability can be prevented.

When the refrigerant stored in the indoor unit $B_2$ is to be caused to flow to the liquid side, the gas-side flow control valve 23 may be completely closed. In this case, however, a difference in pressure between two sides of the flow control valve 23 becomes large, and a large torque is required for opening the flow control valve 23. This leads to employment of a high-torque pulse motor as the flow control valve, resulting in an increase in cost.

In this embodiment, however, since the open state of the gas-side flow control valve 23 is maintained during discharge of the refrigerant from the indoor unit $B_2$, a large pressure difference is not applied to the flow control valve 23. As a result, a flow control valve having a high-torque pulse motor need not be employed, and an increase in cost can be avoided.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A multi-system air-conditioning machine in which a single outdoor unit is connected to a plurality of indoor units, comprising:

a variable-capability compressor, provided in said outdoor unit, for drawing by vacuum a refrigerant through a suction port, compressing the refrigerant, and discharging the refrigerant through a discharge port;

a four-way valve for switching a flow direction of the refrigerant;

an outdoor heat exchanger, provided in said outdoor unit, for exchanging heat of the refrigerant flowing therethrough for heat of outer air;

a plurality of indoor heat exchangers, provided in said indoor units, respectively, for exchanging heat of the refrigerant flowing therethrough for heat of room air;

a plurality of electric expansion valves for decreasing a pressure of the refrigerant flowing therethrough;

a plurality of electric flow control valves for controlling an amount of refrigerant flowing therethrough;

a heat pump type refrigeration cycle in which said discharge port of said compressor is connected to said outdoor heat exchanger through said four-way valve, said outdoor heat exchanger is connected to said indoor heat exchangers through said expansion valves, and said indoor heat exchangers are connected to said suction port of said compressor through said flow control valves and said four-way valve;

means for flowing the refrigerant discharged from said compressor to said indoor heat exchangers through said four-way valve and said flow control valves, flowing the refrigerant output from said indoor heat exchangers to said outdoor heat exchanger through said expansion valves, and returning the refrigerant output from said outdoor heat exchanger to said compressor through said four-way valve, thereby executing a heating operation mode;

means, provided in said indoor units, for detecting air-conditioning loads based on a temperature of the room air;

means for controlling a capability of said compressor in accordance with a sum of the detected air-conditioning loads;

means for controlling opening degrees of said flow control valves in accordance with the detected air-conditioning loads;

means for detecting, in the heating operation mode, a pressure of the refrigerant flowing through a high-pressure-side of said refrigeration cycle; and means for opening one of said expansion valves and one of said flow control valves corresponding to one of said indoor units whose operation is stopped to a predetermined opening degree when the detected pressure is not less than a preset value.

2. A multi-system air-conditioning machine according to claim 1, wherein said expansion valves and said flow control valves are pulse motor valves whose opening degrees are changed depending on the numbers of drive pulses supplied thereto.

3. A multi-system air-conditioning machine according to claim 1, further comprising means for flowing the refrigerant discharged from said compressor to said outdoor heat exchanger through said four-way valve, flowing the refrigerant output from said outdoor heat exchanger to said indoor heat exchangers through said expansion valves, and returning the refrigerant output from said indoor heat exchangers to said compressor through said flow control valves and said four-way valve, thereby executing a cooling operation mode.

4. A multi-system air-conditioning machine according to claim 1, further comprising:

an inverter, provided in said outdoor unit, for outputting a voltage of a predetermined frequency; and a compressor motor which is provided in said outdoor unit, which operates upon reception of the output from said inverter, and a rotating frequency of which changes in accordance with an output frequency of said inverter.

5. A multi-system air-conditioning machine according to claim 4, wherein said compressor is driven by said compressor motor.

6. A multi-system air-conditioning machine in which a single outdoor unit is connected to a plurality of indoor units, comprising:

a variable-capability compressor, provided in said outdoor unit, for drawing by suction a refrigerant through a suction port, compressing the refrigerant, and discharging the refrigerant through a discharge port;

a four-way valve for switching a flow direction of the refrigerant;

an outdoor heat exchanger, provided in said outdoor unit, for exchanging heat of the refrigerant flowing therethrough for heat of outer air;

a plurality of indoor heat exchangers, provided in said indoor units, respectively, for exchanging heat of the refrigerant flowing therethrough for heat of room air;

a plurality of electric expansion valves for decreasing a pressure of the refrigerant flowing therethrough;

a plurality of electric flow control valves for controlling an amount of refrigerant flowing therethrough;

a heat pump type refrigeration cycle in which said discharge port of said compressor is connected to said outdoor heat exchanger through said four-way valve, said outdoor heat exchanger is connected to said indoor heat exchangers through said expansion valves, and said indoor heat exchangers are connected to said suction port of said compressor through said flow control valves and said four-way valve;

means for flowing the refrigerant discharged from said compressor to said indoor heat exchangers through said four-way valve and said flow control valves, flowing the refrigerant output from said indoor heat exchangers to said outdoor heat exchanger through said expansion valves, and returning the refrigerant output from said outdoor heat exchanger to said compressor through said four-way valve, thereby executing a heating operation mode;

means, provided in said indoor units, for detecting air-conditioning loads based on a temperature of the room air;

means for controlling a capability of said compressor in accordance with a sum of the detected air-conditioning loads;

means for controlling opening degrees of said flow control valves in accordance with the detected air-conditioning loads;

means for detecting, in the heating operation mode, a super-heat degree of the refrigerant in said outdoor heat exchanger;

means for controlling the opening degrees of said expansion valves so that the detected super-heat degree becomes a predetermined value;

means for opening, in the heating operation mode, one of said expansion valves and one of said flow control valves that correspond to one of said indoor units whose operation is stopped to small opening degrees;

means for detecting, in the heating operation mode, a temperature of the refrigerant flowing in the high-pressure-side of said refrigeration cycle; and means for increasing an opening degree of one of said expansion vales corresponding to one of said indoor units whose operation is stopped when the detected temperature is not less than a preset value and when one of said expansion valves corresponding to operating one of said indoor units becomes almost completely opened.

7. A multi-system air-conditioning machine according to claim 6, wherein said expansion valves and said flow control valves are pulse motor valves whose opening degrees are changed depending on the numbers of drive pulses supplied thereto.

8. A multi-system air-conditioning machine according to claim 6, further comprising means for flowing the refrigerant discharged from said compressor to said outdoor heat exchanger through said four-way valve, flowing the refrigerant output from said outdoor heat exchanger to said indoor heat exchangers through said expansion valves, and returning the refrigerant output from said indoor heat exchangers to said compressor through said flow control valves and said four-way valve, thereby executing a cooling operation mode.

9. A multi-system air-conditioning machine according to claim 6, further comprising:

an inverter, provided in said outdoor unit, for outputting a voltage of a predetermined frequency; and a compressor motor which is provided in said outdoor unit, which operates upon reception of the output from said inverter, and a rotating frequency of which changes in accordance with an output frequency of said inverter.

10. A multi-system air-conditioning machine according to claim 9, wherein said compressor is driven by said compressor motor.

* * * * *